US005711721A

United States Patent [19]

Johnson et al.

[11] Patent Number: 5,711,721

[45] Date of Patent: Jan. 27, 1998

[54] FERRULE FOR GOLF CLUB

[75] Inventors: Brenda Johnson, Southampton, N.J.; Richard P. Hulock, Quakertown, Pa.

[73] Assignee: Prince Sports Group, Inc., Bordentown, N.J.

[21] Appl. No.: 769,837

[22] Filed: Dec. 19, 1996

[51] Int. Cl.[6] ..... A63B 53/02

[52] U.S. Cl. ..... 473/308; 473/310

[58] Field of Search ..... 473/305–315; 264/245–247; 43/22

[56] References Cited

U.S. PATENT DOCUMENTS 4,484,746 11/1984 Brill ..... 473/251

*Primary Examiner*—Sebastiano Passaniti
*Assistant Examiner*—Stephen L. Blau
*Attorney, Agent, or Firm*—White & Case

[57] ABSTRACT

A ferrule for a golf club comprises a first member having at least one raised element with a top surface, and a second member molded about the first member so as to surround the raised element. The second member has a generally annular, outwardly facing surface that is at least generally flush with the top surface of the raised element, and at least one of the first and second members defines a longitudinal hole therethrough for receiving a golf club shaft. The raised element is made of a different color material than the second member, and can provide a number of functions, such as contain a logo or design, indicate the number of the club, or provide an alignment indicia for the club at the address position.

17 Claims, 4 Drawing Sheets

FERRULE FOR GOLF CLUB

FIELD OF INVENTION

The present invention relates to golf clubs, and more particularly to a ferrule covering the region where the shaft enters the hosel of the clubhead.

BACKGROUND OF THE INVENTION

Golf clubs include a head, which can be made of metal or wood, a shaft which is secured to the head, and a hand grip at the upper end of the shaft. In most clubs, the head includes a hosel, which is a cylindrical tube that extends from the clubhead at an angle and which receives the lower end of the shaft.

Because the outside diameter of the hosel needs to be larger than the shaft, there is a discontinuity in outside diameter of the club at the junction of the shaft and hosel. For such reason, it has been customary to provide a cylindrical or tapered ferrule, which fits around the shaft and abuts the upper end of the hosel. At the hosel juncture, the ferrule has an outside diameter matching the hosel. The outside diameter decreases gradually toward the upper end of the ferrule, so as to be only slightly larger than that of the shaft. In this manner, the ferrule creates the appearance of the shaft blending smoothly into the hosel.

Golf club ferrules have evolved from a traditional single base, with multi-colored rings glued to the top of the base unit, to a more contemporary single based unit of a single material in various different sizes. Ferrules are typically black in color and are formed of materials such as ABS (acrylonitrile-butadiene-styrene) or cellulose acetate, which materials provide a glossy surface finish and thereby produce an attractive appearance.

SUMMARY OF THE INVENTION

The present invention is a ferrule for a golf club, comprising a first member having at least one raised element, and a second member molded about the first member and having a generally annular, outwardly facing surface. The second member surrounds the raised element, and its outwardly facing surface is at least generally flush with the top surface of the raised element so that the raised element design is exposed. The first and second members have different colors so that the raised element is visible. The raised element preferably functions to convey information, such as a logo, the number of the club, or a pointing indicia for aligning the club at the address position.

For a better understanding of the invention, reference is made to the following detailed description of a preferred embodiment, taken in conjunction with the drawings accompanying the application.

DETAILED DESCRIPTION OF PREFERRED EMBODIMENTS

Figure 1:
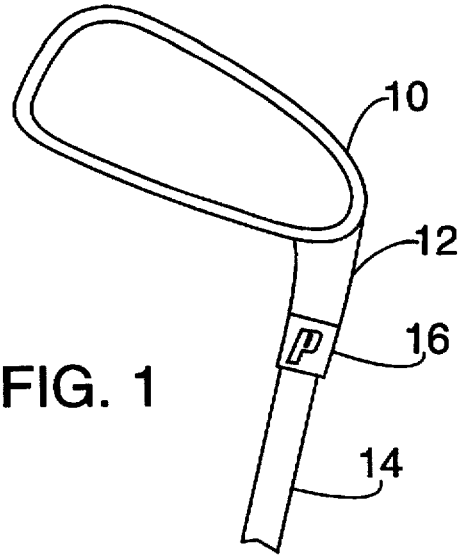
FIG. 1 is a front view of a ferrule according to the invention, shown mounted on a golf club.
Figure 2:
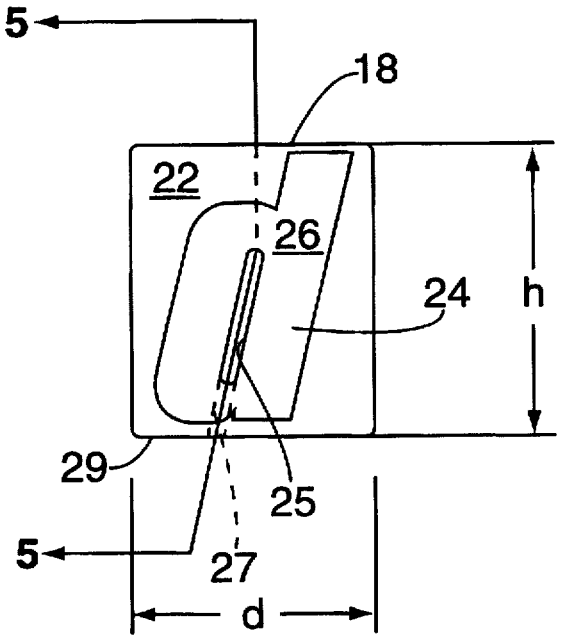
FIGS. 2–4 are front, bottom, and side views, respectively, of a ferrule core.
Figure 3:
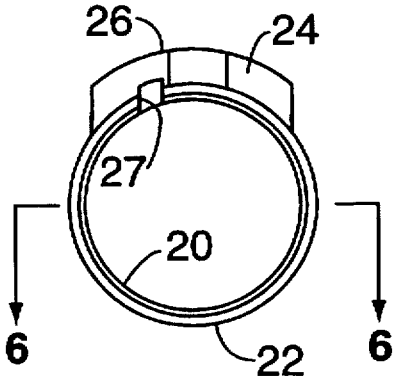
Figure 4:
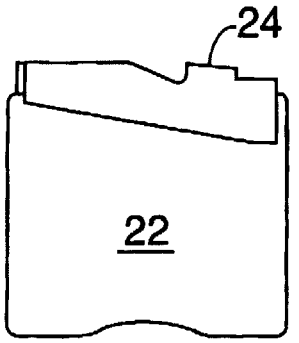
Figure 5:
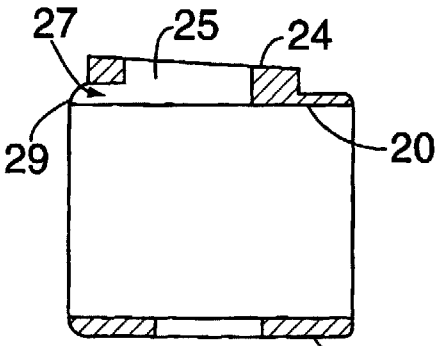
FIG. 5 is a cross-sectional view of the core, taken through lines 5—5 of FIG. 2.
Figure 6:
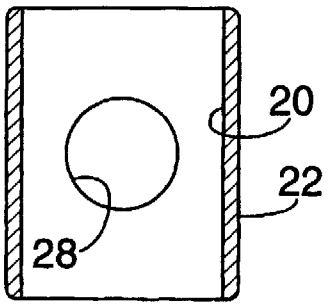
FIG. 6 is a cross-sectional view of the core, taken through lines 6—6 of FIG. 3.

FIG. 1 shows the rear face of an iron-type golf clubhead 10, which includes a hosel 12 extending therefrom. A shaft 14 has its end secured in the hosel 12 in a known fashion. Finally, the golf club includes a ferrule 16, the construction and manufacture of which are described further below, covering the region where the shaft 14 enters the hosel 12.

Referring to FIGS. 2–6, the ferrule shown in FIG. 1 includes a core 18, which has a cylindrical hole 20 extending longitudinally therethrough for the receipt of the shaft 14, and a cylindrical outer surface 22. A raised element 24 extends outwardly from the outer surface 22, and has a top surface 26 which is spaced radially outwardly from the outer surface 22 of the core 18. The core 18 is preferably made of plastic, for example any of the materials currently used to make golf club ferrules, but also may be made of other materials such as elastomers, and may be molded using well known techniques such as injection molding.

Figure 15:
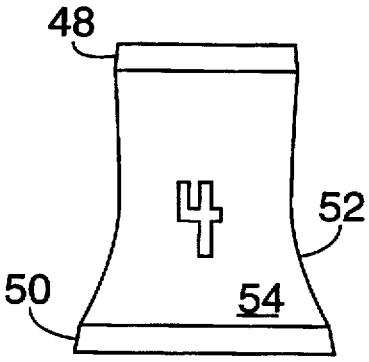
FIG. 15 is a front view of a third embodiment of a ferrule, similar to FIG. 14, but having a curved outer surface.
Figure 16:
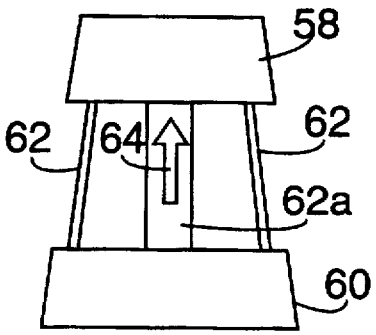
FIG. 16 is a front view of another embodiment of a ferrule core.

The raised element 24 preferably provides information, such as a logo (the example shows the logo "P"), the number of the club (see FIGS. 13–15), or an alignment index for the clubhead at the address position (see FIG. 16). However, the raised element 24 could also be used purely to create an aesthetic design.

In the exemplary embodiment, the core has an outside diameter "d" of 10.8 mm, a height "h" of 13 mm (see FIG. 2), and a wall thickness of approximately 0.7 mm. In order to form the letter "P", the raised element includes a hollow center area 25, and an undercut channel 27 extends from the bottom surface 29 of the core 18 to the channel 27, and a hole 28 is formed through the core wall opposite the raised portion 24.

Figure 7:
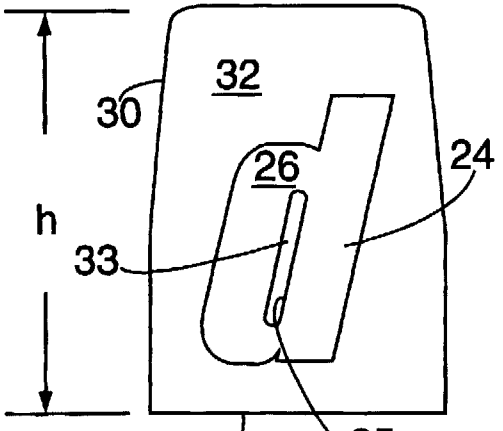
FIGS. 7 and 8 are front and bottom views, respectively, of a ferrule formed using the core of FIGS. 2–6.
Figure 8:
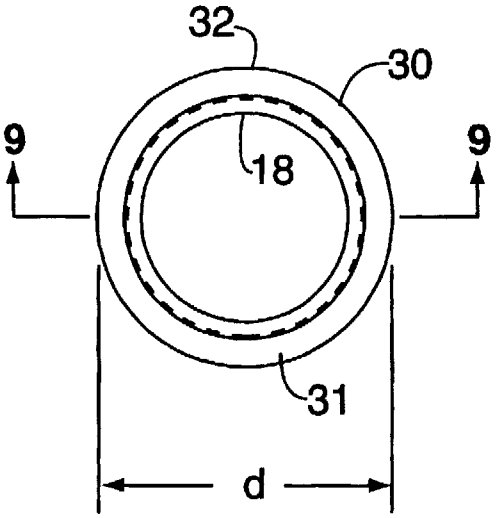
Figure 9:
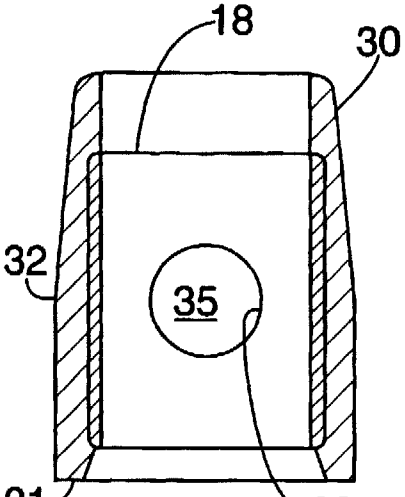
FIG. 9 is a cross-sectional view of the ferrule, taken through lines 9—9 of FIG. 8.

Referring to FIGS. 7–9, a second member 30 is molded over the core 18, for example, using known insert molding techniques, so as to be in contact with, and bond to, the core's outer surface 22, to surround and embed the raised element 24, and thereby form the ferrule 16. The outside surface 32 of the second member 30 preferably has a diameter that decreases along the axis of the ferrule 16, although it can be given any aesthetically pleasing shape. In the example shown, the second member 30 has a height "h" (see FIG. 7) of 18 mm, and a diameter "d" (see FIG. 8) that decreases from 13.6 mm at the bottom 31 to 11.5 at the top.

When the second member 30 is molded around the core 18, plastic is able to flow into the center area 25 of the "P" through the undercut channel, producing a portion 33 that fills center area 25 (see FIG. 7). Also, when the second member 30 is molded, a portion 35 of the plastic material fills the hole 28 in the core 18 (see FIG. 9). In addition to any chemical bonding between the core 18 and second member 30, the fact that the second member 30 surrounds the raised member 24, and has a portion 35 filling hole 28, produces a positive locking engagement between the core 18 and the outer member 30, to prevent rotation or axial movement between the two members 18, 30. The portion of the second member 30 filling the undercut recess 27 also acts to lock the two members together.

Figure 10:
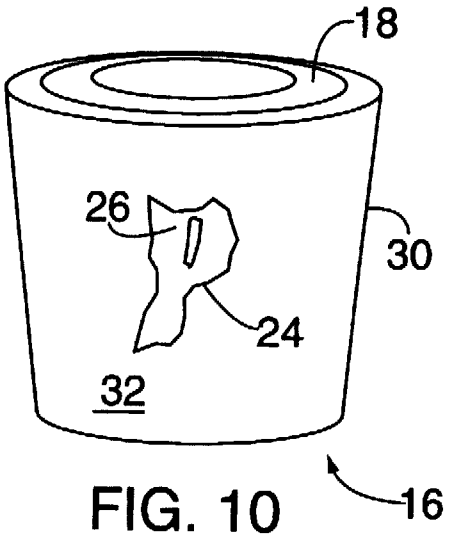
FIG. 10 is a perspective view of the ferrule, after final molding but prior to being sanded.

The mold for the second member 30 is preferably shaped so that the outside surface 32 of the second member 30 is flush with the top surface 26 of the raised element 24. However, as shown in FIG. 10 in a somewhat exaggerated form, when the second member 30 is molded over the core, there is a tendency for the material forming the second member 30 to bleed and thereby partially cover the edges of the raised element 24, blurring the image. For such reason, it is preferable according to the present invention to mold the ferrule 16 so that its outside diameter is slightly larger than ultimately required, for the reason now to be described.

Figure 12:
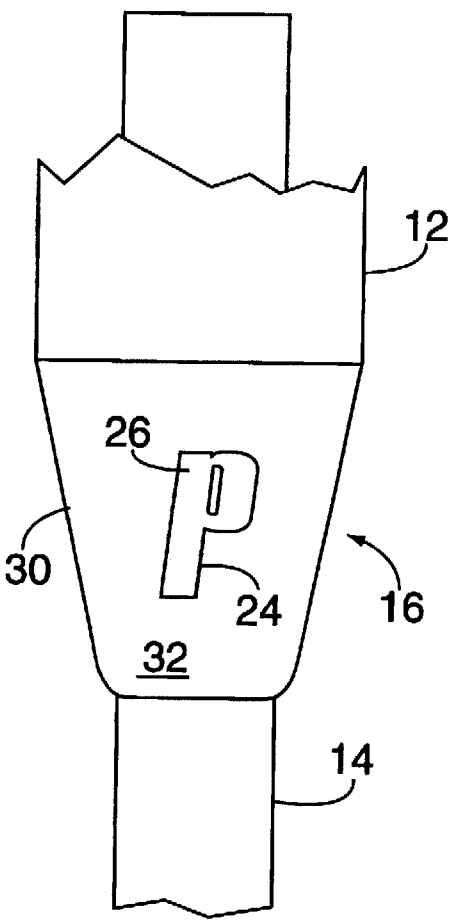
FIG. 12 is a front view of the ferrule, shaft, and hosel of FIG. 11 after the ferrule has been sanded.
Figure 11:
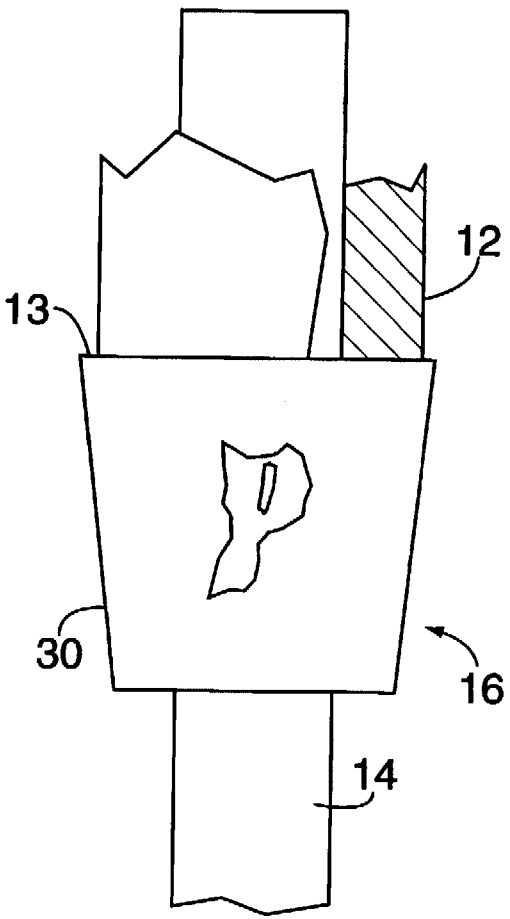
FIG. 11 is a front view, partially in section, showing the ferrule of FIG. 10 being mounted about the shaft of a clubhead.

FIGS. 11–12 show two steps in the assembly and mounting of the ferrule 16 on the shaft. In FIG. 11, the shaft 14 has been inserted through the ferrule 16 and into the cylindrical opening of the hosel 12, where it is secured in a known manner. As shown, the upper end 13 of the ferrule 16 abuts against the lower face of the hosel 12. The ferrule 16 can be adhered to the hosel 12 and/or the shaft 14, while in this position, in a known manner.

Referring to FIG. 12, once in position, the ferrule 16 is sanded down to its final shape, which in the example is a generally frustoconical shape, flush with the hosel 12, and curved into the shaft 14. As shown in FIG. 12, when the outside surface 32 of the second member 30 is sanded down, any material covering the top surface 26 of the raised element 24 is removed, revealing a sharp image of the raised element 24.

The material used to form the core 18 may either be the same as, or different from, the material used to make the second member 30. For example, the materials forming the core and second member 30 may both be a material like ABS or cellulose acetate, to provide a shiny surface, but of different colors, e.g., green-on-black. Alternatively, the two components may be formed of different materials, to produce differing textures or surface finishes. Preferably, the core and second member have a hardness in the range of 40–80 Shore D, and most preferably 65 Shore D. However, other hardnesses can be employed. Also, if desired, the core, which contacts the shaft, may be elastomeric for vibration damping, whereas the material forming the second member is a harder plastic. Regardless of whether the material compositions are the same or different, preferably the materials used to make the two ferrule members have different colors to highlight the design of the raised element 24.

Figure 13:
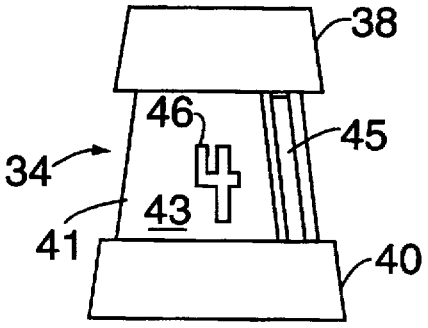
FIG. 13 is a front view of another embodiment of a ferrule core.
Figure 14:
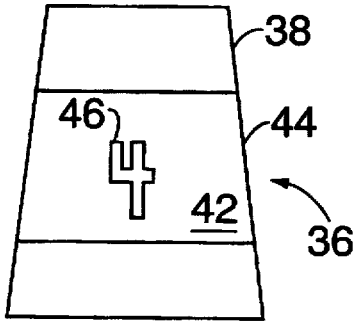
FIG. 14 is a front view of the completed ferrule of the FIG. 13 embodiment.

FIGS. 13–14 show a second embodiment of a core 34 and the resulting ferrule 36, respectively, in which the core 34 has a pair of longitudinally spaced surface portions 38, 40, separated by an annular connecting web 41. A raised element 46 extends outwardly from the outer surface 43 of the web 41.

As shown in FIG. 14, the second member 44 is molded over the core 34 so that the edges of the two spaced portions 38, 40 meet flush with the outwardly facing surface 42 of the second member 44.

Optionally, the core 34 may be provided with an additional projection, e.g., rib 45, extending radially outwardly from the web surface 41 at a location spaced from the raised element 46. When the second member 44 is molded over the core 34, it surrounds the rib 45 to provide additional interlocking between the two members 34, 44. As shown, the rib 45 extends radially outward from the surface 43 of the web 41 a distance less than portions 38, 40, so that when the second member 44 is molded it covers the rib 45. However, if desired, rib 45 could extend to be flush with surface 42 and thereby be exposed. Also, although for purposes of illustration rib 45 is shown on the same side of the web 41 as raised element 46, in practice it would be preferable to provide the rib 45 or other second projecting member on a surface opposite to raised member 46. In such manner, the raised element 46 and rib 45 lock the two members 34, 44 against relative movement on opposite sides of the core 34.

As in the case of the prior embodiment, the second member 44 surrounds and embeds the raised element 46 of the core 34, which in this case represents the number of the club (in the example, a number "4" iron).

FIG. 15 shows a modification of FIGS. 13–14, in which the longitudinally spaced surface portions 48, 50 extend a shorter longitudinal distance than members 38, 40, and in which the second member 52 has a bell shaped outer surface 54.

FIG. 16 shows another embodiment of a core 56 in which, similar to FIGS. 13–14, a pair of longitudinally separated surface portions 58, 60 are designed to be flush with the second member when molded. However, unlike FIG. 13, in which the spaced surface portions 38, 40 are separated by an annular web 41, in FIG. 16 the upper and lower surface portions 58, 60 are connected by a plurality of struts 62, one of which, **62*a*, supports the raised element 64. As in the case of the prior embodiments, in FIG. 16 the second member would be molded over the core, e.g., using insert molding techniques, but unlike the prior embodiments, in which the core defined the shaft-receiving hole 20, in the case of FIG. 16** the second member would need to be molded to form such hole.

The foregoing represent preferred embodiments of the invention. Variations and modifications will be apparent to persons skilled in the art, without departing from the inventive concepts disclosed herein. For example, while in the preferred embodiments the raised, indicia-bearing portion is flush with the outer surface of the second member, if desired the upper surface of the raised element can lie slightly above or below the surface of the second member. Also, while in the examples the raised element has been molded as part of the core, if desired the core could be the raised element alone, i.e., such that the second member is insert molded around the raised element, or the insert member could be formed separately from the rest of the core, and secured to the core prior to insert molding the second member. All such modifications and variations are intended to be within the skill of the art, as defined in the following claims.

We claim:

1. A ferrule for a golf club, comprising:

a first member having at least one raised element with a top surface; and a second member molded about said first member so as to surround said raised element, and having a generally annular, outwardly facing surface that is at least generally flush with said top surface for exposing said top surface; wherein said first and second members are made from materials of different colors, and wherein at least one of said first and second members defines a longitudinal hole therethrough for receiving a golf club shaft.

2. A ferrule according to claim 1, wherein said first member comprises a core having at least one outer surface from which said raised element projects.

3. A ferrule according to claim 2, wherein said outer surface is a continuous annular surface for at least part of the length of said ferrule.

4. A ferrule according to claim 3, wherein said outer surface is a continuous annular surface for the entire length of said ferrule.

5. A ferrule according to claim 4, wherein said core defines said hole.

6. A ferrule according to claim 5, wherein said core is made of an elastomeric material which, when mounted on a golf club shaft, will contact said shaft and thereby damp vibration.

7. A ferrule according to claim 1, wherein said first member and second member are made of different materials to produce different surface textures.

8. A ferrule according to claim 1, wherein said first member comprises a core having at least one surface portion that is generally flush with said outwardly facing surface of said second member.

9. A ferrule according to claim 8, wherein said first member has a pair of longitudinally spaced surface portions that are generally flush with said outwardly facing surface of said second member, which is located therebetween.

10. A ferrule according to claim 9, wherein said core comprises a plurality of strut members connecting said pair of surface portions, wherein one of said strut members carries said raised element.

11. A ferrule according to claim 1, wherein said raised element is in the shaped of information such as a logo, club number, or pointing indicia.

12. A ferrule according to claim 11, wherein said second member has an outside surface which, along said axis, decreases in diameter.

13. A ferrule according to claim 11, wherein said second member has an outside surface which decreases in diameter along the axis of the ferrule.

14. A ferrule according to claim 2, wherein said outer surface contains a hole, and wherein said second member is molded so as to fill such hole for interlocking said first and second members.

15. A ferrule according to claim 2, wherein said outer surface contains an outwardly projecting member, and wherein said second member is molded so as to surround said projecting member for interlocking said first and second members.

16. A method of making a ferrule for a golf club, comprising the steps of:

molding a first member having at least one raised element with a top surface; and molding a second member about said first member so as to surround said raised element, and have an outwardly facing surface that is at least generally flush with said top surface such that said top surface is exposed, wherein said first and second members define a hole therethrough for receiving a shaft, and wherein said first and second members are molded from different color materials.

17. The method of claim 16, comprising further the step of abrading said outwardly facing surface sufficiently to clearly expose said raised element.

* * * * *